US006896586B2

(12) United States Patent
Pham et al.

(10) Patent No.: US 6,896,586 B2
(45) Date of Patent: May 24, 2005

(54) METHOD AND APPARATUS FOR HEATING POLISHING PAD

(75) Inventors: Xuyen Pham, Fremont, CA (US); Tuan Nguyen, San Jose, CA (US); Ren Zhou, Fremont, CA (US); David Wei, Fremont, CA (US); Linda Jiang, Milpitas, CA (US); Katgenhalli Y. Ramanujam, Fremont, CA (US); Joseph P. Simon, Newark, CA (US); Tony Luong, San Jose, CA (US); Sridharan Srivatsan, Sunnyvale, CA (US); Anjun Jerry Jin, Milpitas, CA (US)

(73) Assignee: Lam Research Corporation, Fremont, CA (US)

( * ) Notice: Subject to any disclaimer, the term of this patent is extended or adjusted under 35 U.S.C. 154(b) by 8 days.

(21) Appl. No.: 10/112,628

(22) Filed: Mar. 29, 2002

(65) Prior Publication Data

US 2003/0186623 A1 Oct. 2, 2003

(51) Int. Cl.[7] ..... B24B 49/00
(52) U.S. Cl. ..... 451/7; 451/8; 451/53
(58) Field of Search ..... 451/7, 41, 53, 451/287, 303, 307, 449, 8, 296

(56) References Cited

U.S. PATENT DOCUMENTS

| | | | | | |
|---|---|---|---|---|---|
| 5,873,769 | A | * | 2/1999 | Chiou et al. | 451/7 |
| 6,000,997 | A | * | 12/1999 | Kao et al. | 451/7 |
| 6,224,461 | B1 | * | 5/2001 | Boehm et al. | 451/7 |
| 6,352,470 | B2 | * | 3/2002 | Elledge | 451/285 |
| 6,533,647 | B1 | * | 3/2003 | Brunelli | 451/53 |
| 6,544,111 | B1 | * | 4/2003 | Kimura et al. | 451/288 |
| 2003/0045205 | A1 | * | 3/2003 | Herb et al. | |

* cited by examiner

*Primary Examiner*—Dung Van Nguyen
(74) *Attorney, Agent, or Firm*—Martine Penilla & Gencarella LLP

(57) ABSTRACT

A temperature controlling system for use in a chemical mechanical planarization (CMP) system having a linear polishing belt, a carrier capable of applying a substrate over a preparation location over the linear polishing belt is provided. The temperature controlling system includes a platen having a plurality of zones. The temperature controlling system further includes a temperature sensor configured determine a temperature of the linear polishing belt at a location that is after the preparation location. The system also includes a controller for adjusting a flow of temperature conditioned fluid to selected zones of the plurality of zones of the platen in response to output received from the temperature sensor.

16 Claims, 12 Drawing Sheets

METHOD AND APPARATUS FOR HEATING POLISHING PAD

BACKGROUND OF THE INVENTION

1. Field of the Invention

This invention relates generally to chemical mechanical planarization apparatuses, and more particularly to methods and apparatuses for improved uniformity in chemical mechanical planarization applications via controlling temperature of a polishing pad.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion zones are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12, which moves linearly in respect to the surface of the wafer 16. The belt 12 is a continuous belt rotating about rollers (or spindles) 20. A motor typically drives the rollers so that the rotational motion of the rollers 20 causes the polishing belt 12 to be driven in a linear motion 22 with respect to the wafer 16.

A wafer carrier 18 holds the wafer 16. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12 while applying pressure to the polishing belt. The polishing belt 12 is a continuous belt typically made up of a polymer material such as, for example, the IC 1000 made by Rodel, Inc. layered upon a supporting layer. The polishing belt 12 is rotated by the rollers 20 which drives the polishing belt in the linear motion 22 with respect to the wafer 16. In one example, a fluid bearing platen 24 supports a section of the polishing belt under the zone where the wafer 16 is applied. The platen 24 can then be used to apply fluid against the under surface of the supporting layer. The applied fluid thus forms a fluid bearing that creates a polishing pressure on the underside of the polishing belt 12 which is applied against the surface of the wafer 16. Unfortunately, because the polishing rate produced by the fluid bearing typically cannot be controlled very well, the polishing pressure applied by the fluid bearing is non-uniform. Specifically, the temperature of the polishing belt 12 often varies during the polishing process. The polishing belt 12 typically starts off cold and becomes warmer during the wafer polishing. As wafer polishing progresses, the temperature of the polishing belt increases due to the friction between the polishing belt 12, the slurry, and the wafer 16. This is extremely problematic because as the temperature of the polishing belt 12 increases, this increases the temperature of the slurry used in the polishing process which then increases the polishing rate of the wafer 16. In addition, when air is used as the fluid bearing, the air released from the platen 24 is generally extremely cold. This occurs because as the air is outputted from the air output holes in the platen 24, air expands and therefore becomes colder. Therefore, due to the frictional heat and the cold air from the platen 24, it is generally very difficult to control the polishing belt temperature. As a result, due to the fact that the prior art polishing system designs do not properly control polishing dynamics, uneven polishing and inconsistent wafer polishing may result thereby decreasing wafer yield and increasing wafer costs.

In view of the foregoing, there is a need for an apparatus that overcomes the problems of the prior art by having a platen that improves polishing pad temperature control and reduces polishing rate discrepancies.

SUMMARY OF THE INVENTION

Broadly speaking, embodiments of the present invention fill these needs by providing a polishing pad warming system that provides wafer polishing uniformity control during a CMP process by enabling usage of different temperature air in different zones within a platen.

In one embodiment, a temperature controlling system for use in a chemical mechanical planarization (CMP) system having a linear polishing belt, a carrier capable of applying a substrate over a preparation location over the linear polishing belt is provided. The temperature controlling system includes a platen having a plurality of zones. The temperature controlling system further includes a temperature sensor configured determine a temperature of the linear polishing belt at a location that is after the preparation location. The system also includes a controller for adjusting a flow of temperature conditioned fluid to selected zones of the plurality of zones of the platen in response to output received from the temperature sensor.

In another embodiment, a temperature controlling system for use in a chemical mechanical planarization (CMP) system having a linear polishing belt, a carrier capable of applying a substrate over a preparation location over the linear polishing belt is provided. The temperature controlling system includes a platen having a plurality of zones. The system also includes a temperature sensor that determines a temperature of the linear polishing belt at a location that is after the preparation location. The system further includes a heating device being positioned before the preparation location and directed toward a surface of the linear polishing belt. The system also includes a controller for adjusting an output from the heating device in response to output received from the temperature sensor.

A method for heating a polishing pad during chemical mechanical planarization (CMP) is provided. The method includes determining whether a temperature of the polishing pad is substantially equal to a set point temperature. The method also determines if the temperature of the polishing pad is not substantially equal to the set point temperature. If the temperature of the polishing pad is not substantially equal to the set point temperature, the method adjusts at least one of a temperature and a pressure of a heated fluid being outputted from at least one pressure zone of a platen. The adjusting substantially equalizes the temperature of the polishing pad and the set point temperature.

In another embodiment, an apparatus for heating a polishing pad during chemical mechanical planarization (CMP) is disclosed. The apparatus includes a platen disposed under the polishing pad. The platen has a platen plate with at least one pressure zone being capable of outputting a heated fluid to an underside portion of the polishing pad. The apparatus also includes an internal manifold coupled to the platen by at least one fluid throughput. The internal manifold is capable of delivering the heated fluid to the at least one pressure zone of the platen by way of the at least one fluid throughput. The apparatus further includes an external manifold coupled to the internal manifold by at least one manifold throughput. The external manifold is capable of delivering the heated fluid to the internal manifold. The apparatus also includes a heater connected to the external manifold by at least one heater throughput. The heater is capable of heating the fluid to one of a plurality of set temperatures and is capable of delivering the heated fluid to the external manifold. The apparatus further includes a controller connected to the internal manifold and a polishing pad temperature sensor. The controller is capable of monitoring a polishing pad temperature and adjusting a delivery of the heated fluid from the internal manifold to the at least one pressure zone to equalize the polishing pad temperature to the set point temperature.

Because of the advantageous effects of applying controlled fluid pressure of a controlled temperature in various portions of the platen, embodiments of the present invention provide significant improvement in planarization rate consistency. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a CMP system that provides for polishing uniformity control during a CMP process by controlling polishing pad temperature through utilization of different fluid temperature outputs for different zones of a platen during the CMP process. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

In general, embodiments of the present invention provide a CMP system that has the unique ability to manage polishing rates of a wafer by controlling the temperature of a polishing pad during a CMP process. It should be understood that the CMP system may use any suitable polishing pad structure such as, for example, a linear polishing belt, stainless steel supported polishing belt, etc. The CMP system controls temperature of fluids inputted into the platen to enable different zones within the platen to output the same or different temperatures of fluid onto the polishing pad. The outputting of controlled temperature fluid generates a fluid bearing that enables the polishing pad to be set at certain temperatures. When polishing pad temperatures are properly managed, this creates controlled polishing rates allowing the wafer polishing to be more consistent and efficient. Specifically, a control unit can manage input of heated fluid into different zones of the platen through feedback from a polishing pad temperature sensor thus forming an intelligent feedback loop to obtain controlled polishing pad temperatures. As a result, polishing pressure differences and inconsistencies arising from differing polishing pad temperatures may be managed in a highly regulated manner.

A platen used within the CMP system disclosed herein may include any number of pressure zones within and outside the area of the wafer. Each pressure zone has a plurality of fluid holes that may be utilized to output fluid at different temperatures onto a backside (side opposite the side that polishes the wafer) of the polishing pad thus compensating for polishing pad dynamics inadequacies. It should be understood that the embodiments of the present invention can be utilized for polishing any size wafer such as, for example, 200 mm wafers, 300 mm wafers.

A fluid as utilized herein may be any type of gas or liquid. Therefore, CMP systems as described below may utilize temperature controlled gas or liquid to control the polishing rate of the wafer. In addition, different temperatures of fluid may be applied at differing pressures over certain pressure zones of the platen. Such a configuration enables extremely flexible wafer polishing rate management.

Figure 1A:
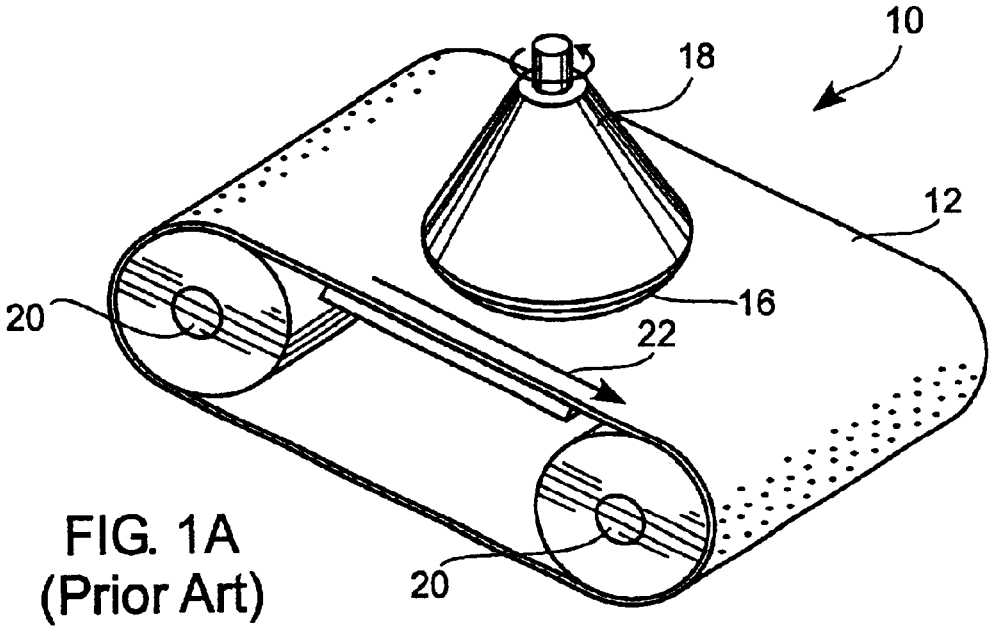
FIG. 1A (Prior Art)
FIG. 1A shows a linear polishing apparatus which is typically utilized in a CMP system.
Figure 1B:
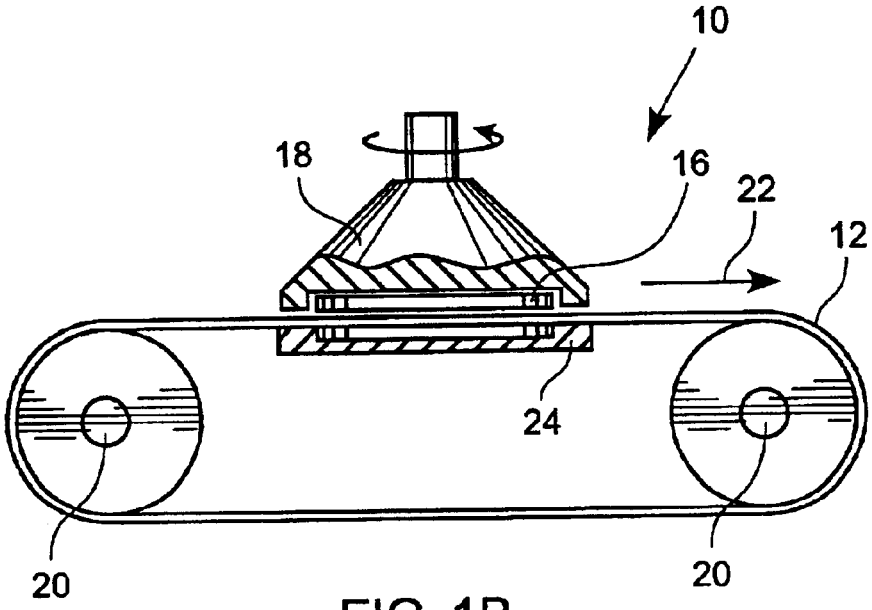
FIG. 1B (Prior Art)
FIG. 1B shows a side view of the linear polishing apparatus.
Figure 2A:
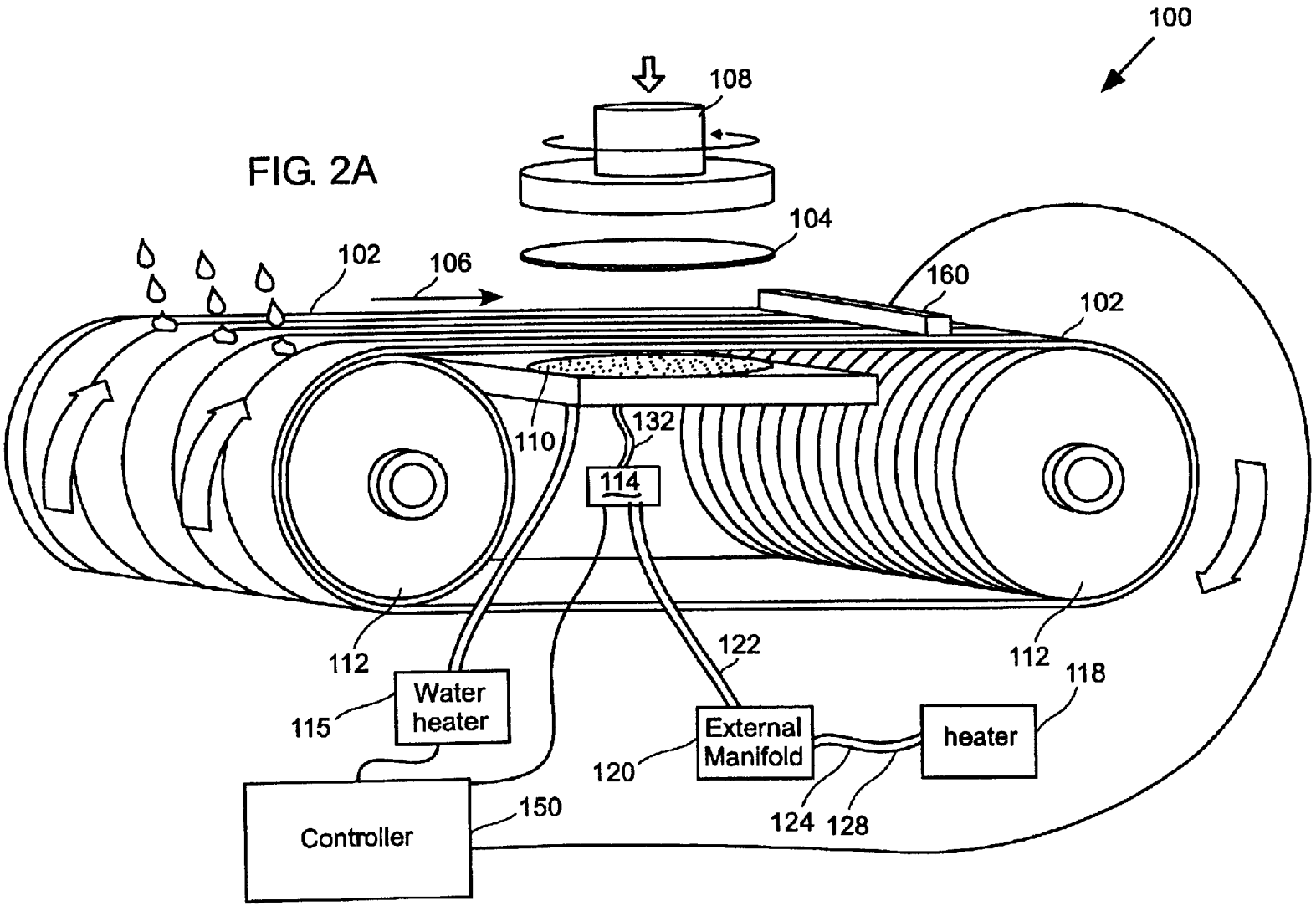
FIG. 2A shows a side view of a chemical mechanical planarization (CMP) system in accordance with an embodiment of the present invention.

FIG. 2A shows a side view of a chemical mechanical planarization system 100 in accordance with an embodiment of the present invention. In this embodiment, a carrier head 108 may be used to secure and hold a wafer 104 in place during processing. A polishing pad 102 preferably forms a continuous loop around rotating drums 112. The polishing pad 102 generally moves in a direction 106 at a speed of about 400 feet per minute, however, it should be noted that this speed may vary depending upon the specific CMP operation. As the polishing pad 102 rotates, the carrier 108 may then be used to lower the wafer 104 onto a top surface of the polishing pad 102.

A platen 110 may support the polishing pad 102 during the polishing process. The platen 110 may utilize any suitable type of bearing such as a liquid bearing or a gas bearing. Fluid pressure from an internal manifold 114 is inputted through the platen 110 by way of independently controlled pluralities of output holes that may be utilized to provide upward force to the polishing pad 102 to control the polishing pad profile. The fluid pressure from the internal manifold 114 to the platen 110 is supplied through fluid throughput 132. The fluid throughput 132 may include one or more pathways that may carry fluid from the internal manifold 114 to the platen 110. The fluid throughput 132 supplies the different platen zones so fluid output out of various zones of the platen 110 may be controlled. Therefore, for any number of separate fluid output zones of the platen 110 that may be controlled, there may exist an equal number of pathways to supply each of those zones from the internal manifold 114. It should be appreciated that there may be any suitable number of fluid output zones in the platen 110 with any suitable number of corresponding pathways supplying the zone(s).

The internal manifold 114 receives fluid input from an external manifold 120 through manifold throughput 122. The manifold throughput 122 may include any suitable number of pathways depending on the number of fluid temperatures desired to be utilized. The pathways that may comprise the manifold throughput 122 may carry fluid of different temperatures or the same temperatures depending on the variety of fluid temperatures desired. In one embodiment, every pathway of the manifold throughput 122 can carry fluid of a different temperature. In such an embodiment, the internal manifold 114 is configured so it can receive fluid of differing temperatures and manage them so different zones of the platen can output any suitable fluids of any suitable temperature desired to be outputted.

The external manifold 120 receives heated fluid from a heater 118 by way of a heater throughput 124. The heater throughput 124 may include any suitable number of pathways depending on the number of different fluid temperatures desired to utilize in the CMP process. It should be understood that the heater 118, the external manifold 120, and the internal manifold 114 may manage and transport any type of fluid for utilization in the CMP process such as, for example, air, water, etc. In one embodiment, air may be transported so certain zones of the platen may output differing (or the same) temperatures of air. In addition, a water source 115 may supply heated water to a pre-wet output and a post-wet output of the platen 110. The water source 115 may supply water that is of any suitable temperature depending on the application desired. In one embodiment, the temperature of the water supplied to the platen 110 by the water source 115 is about 60 degrees C. The water source 115 is connected to the controller 150 which can manage the temperature of the water outputted by the pre-wet output and the post-wet output in conjunction with managing the heated air output from the platen 110. It should be appreciated that although the controller 150, the water source 115, the platen 110, the external manifold 120, and the heater 118 are seen figuratively as being separate components, two or more of the components may be combined to form one component. For example, in one embodiment, the platen 110, the controller 150, the internal manifold 114, and the heater 118 may be combined into one structure. In one embodiment, the internal manifold 114 as shown in FIG. 2A may be located within the confines of the CMP machine. It should be appreciated that the external manifold 120 may be any suitable type of manifold that is outside of the CMP device itself. The external manifold 120, in one embodiment, may be a facilities manifold outside of the confines of the CMP machine.

A controller 150 may monitor a temperature of the polishing pad 102 by use of a temperature sensor 160. It should be appreciated that the controller 150 may be any suitable type of controlling apparatus that can intelligently manage the temperature of the polishing pad 102 through intelligent control of heated fluid output through the various fluid output zones of the platen 110. Depending on the temperature sensed by the temperature sensor 160, the controller 150 may manage the amount of fluid output as well as the fluid temperature of the fluid output out of any, some, or all of the air output zones of the platen 110. It should be understood that the CMP system described herein may utilize any suitable type of platen which may have any suitable number of independently controllable air output zones. The air output zones can therefore apply heated fluid to an underside of the polishing pad 102 to attain the desired polishing pad temperature. Therefore, a feedback loop may between the temperature sensor 160, the controller 150, and the internal manifold 114 may be utilized to intelligently control and manage temperature controlled fluid output from independently controlled fluid output zones of the platen 110.

It should be appreciated that any suitable type CMP system 100 configuration may be used where heated fluid may be controllably applied to the polishing pad 102. In one embodiment, the internal manifold 114 may be part of the platen 110. In another embodiment, there may be a heater directly connected to the internal manifold 114 without using the external manifold 120. In yet another embodiment, the external manifold 120 may direct fluid into various fluid output zones of the platen 110 without necessitating the existence of the internal manifold 114. In another embodiment, the heater 118 may provide heated fluid directly to the platen 110 which may have a self enclosed internal manifold. In these various embodiments, the controller 150 manages heated fluid output by controlling the fluid output from whatever suitable apparatus that directs output to the various output zones of the platen 110.

In one embodiment, the set point temperature of the polishing pad is below 125 degrees F. It should be understood that the set point temperature may be any suitable temperature depending on the polishing rate desired. If a higher polishing rate is desired, the set point may be a higher temperature. If a lower polishing rate is desired, the set point may be a lower temperature.

Figure 2B:
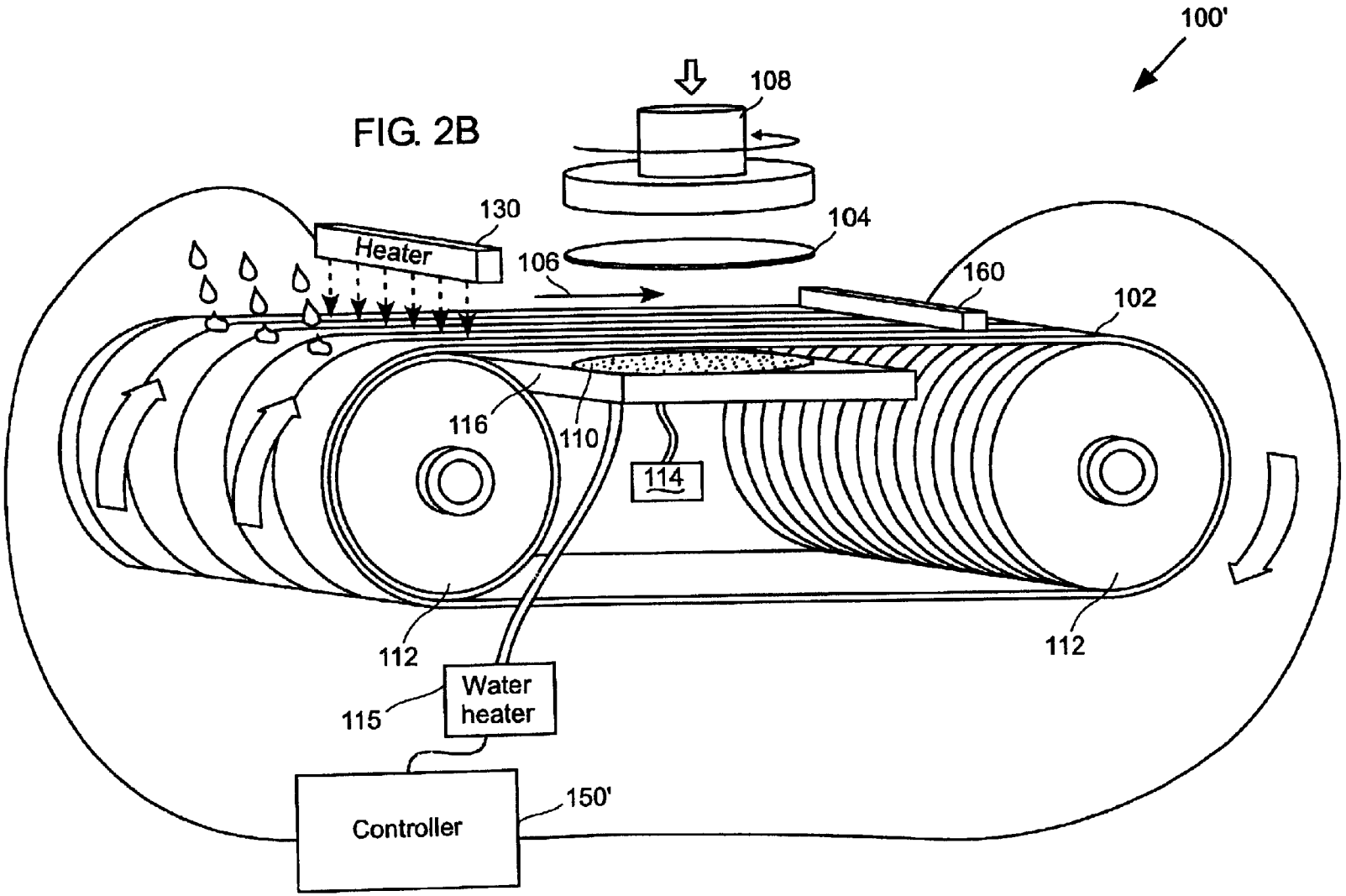
FIG. 2B shows a side view of a chemical mechanical planarization (CMP) system with a polishing pad heater in accordance with an embodiment of the present invention.

FIG. 2B shows a side view of a chemical mechanical planarization (CMP) system 100' with a polishing pad heater in accordance with an embodiment of the present invention. In this embodiment, the system 100' includes a polishing pad heater 130 that may be utilized to heat the polishing pad 102. In one embodiment, the polishing pad heater 130 is disposed above the polishing pad 102 on a trailing edge side of the platen 110. The polishing pad heater 130 may use any suitable way to heat the polishing pad 102. In one embodiment, the heater 130 is a radiant heater that is a heat lamp which may heat the polishing pad 102. A controller 150' may receive input from the temperature sensor 160 and determine an amount of heat outputted by the heater 130 to attain or retain the set point temperature for the polishing pad 102. In one embodiment, the polishing pad heater 130 may operate at a temperature of up to 250 degrees F. to raise the polishing pad temperature. Therefore, the temperature of the polishing pad 102 may be intelligently controlled by using the heat lamp 130 to heat the polishing pad 102 while the temperature of the polishing pad 102 is monitored by the temperature sensor and the controller 150'.

Figure 3:
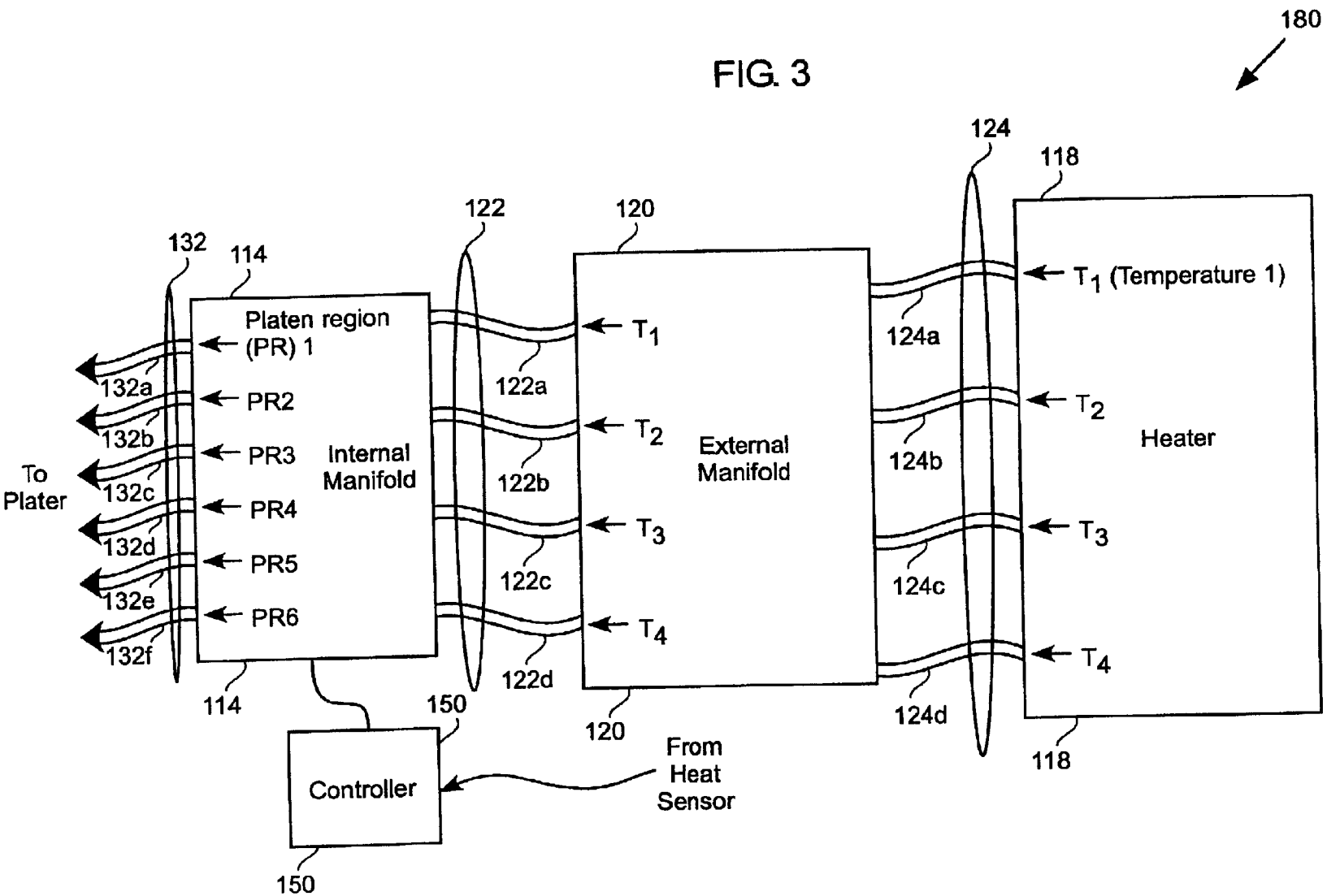
FIG. 3 shows a diagram illustrating connections between the internal manifold, the external manifold, and the heater in accordance with one embodiment of the present invention.

FIG. 3 shows a diagram 180 illustrating connections between the internal manifold 114, the external manifold 120, and the heater 118 in accordance with one embodiment of the present invention. In one embodiment, fluids of four different temperatures are utilized. Fluids such as clean dry air, deionized water, etc. may be utilized in the described apparatus herein. In one embodiment, air may heated by the heater 118 and transported to the platen 110 through the external manifold 120 and the internal manifold 114. In another embodiment, a combination of air and water may be heated by the heater 118 and transported through the external manifold 120 and the internal manifold 114. In yet another embodiment, water may be heated by the heater 118 and transported to the platen 110 through the external manifold 120 and the internal manifold 114. It should be appreciated that the heater 118 may output any suitable number of different fluid temperatures to the external manifold 120 which may in turn supply the any suitable corresponding number of different fluid temperatures to the internal manifold 114.

In one embodiment, the internal manifold 114 has an electronic pressure (EP) regulator to control fluid flow to the platen 110. In this way, the internal manifold 114 may control fluid pressure to the platen 110 and supply any suitable temperature fluid to any suitable fluid output zone of the platen 110. In one embodiment, the heater 118 may output fluids with temperatures of 50 degrees F., 60 degrees F., 70 degrees F., and 80 degrees F. through tubes 124*a*, 124*b*, 124*c*, and 124*d* respectively. Preferably, the temperatures of 125 degrees F. and below are utilized. The tubes 124*a*, 124*b*, 124*c*, and 124*d* may, in one embodiment, define the heater throughput 124. The external manifold 120 may then output the fluid inputs from the tubes 124*a*, 124*b*, 124*c*, and 124*d* to the internal manifold 114 through tubes 122*a*, 122*b*, 122*c*, and 122*d* respectively. In one embodiment, the tubes 122*a*, 122*b*, 122*c*, and 122*d* may define the manifold throughput 122. The internal manifold 114 may then, through management from the controller 150, control fluid temperature and pressure outputs to, in one embodiment, six different fluid output zones of the platen 110 through tubes 132*a*, 132*b*, 132*c*, 132*d*, 132*e*, and 132*f* which may define, in one embodiment, fluid throughput 132. It should be appreciated that the heater 118 may be any suitable type of heater that can heat the desired volume of fluid to a desired temperature. In one embodiment, the heater 118 may be a 40 kW heater that supplies fluids with temperatures of up to a 125 degrees F.

Figure 4A:
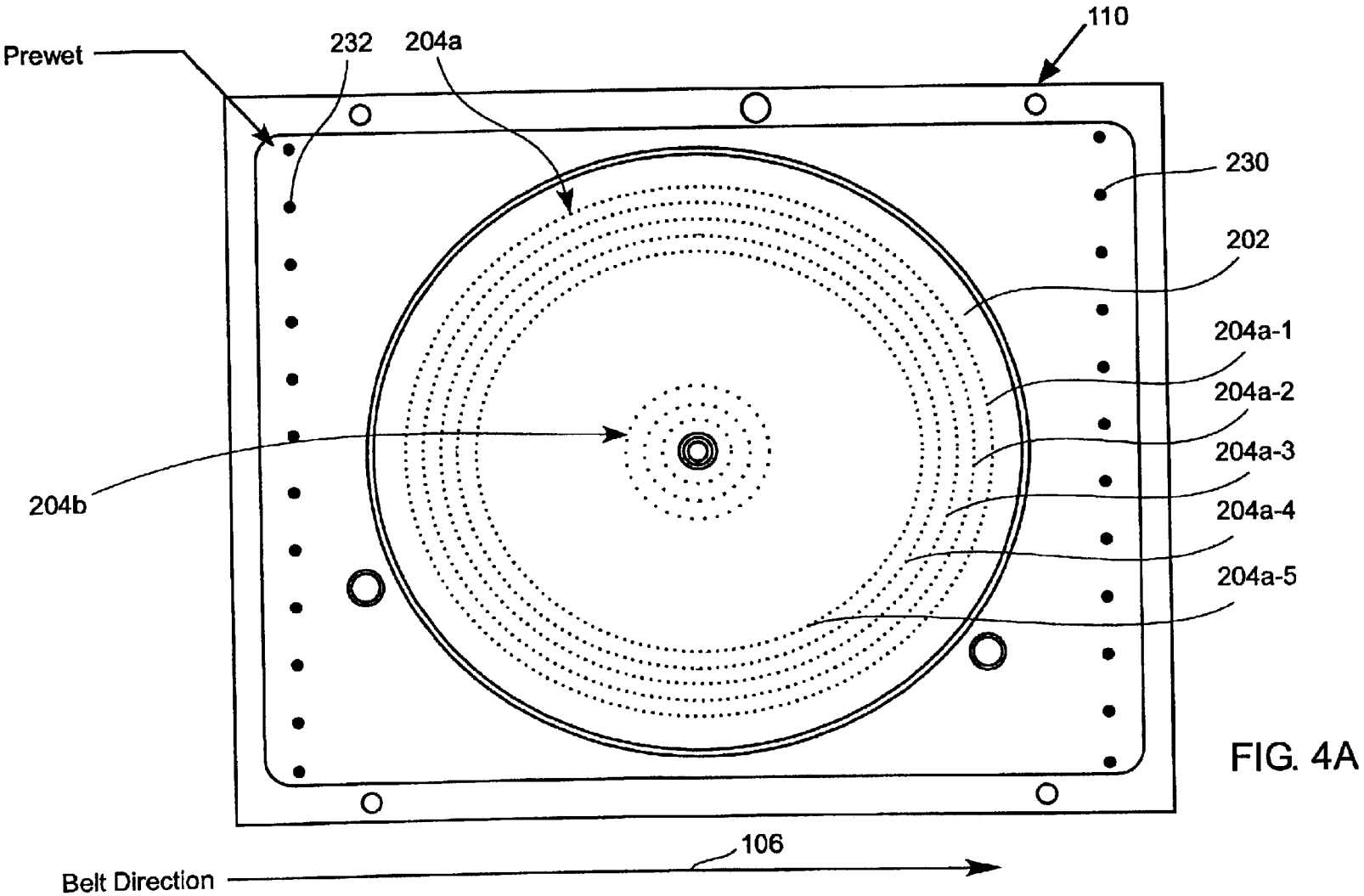
FIG. 4A shows a close-up overhead view of the platen in accordance with one embodiment of the present invention.

FIG. 4A shows a close-up overhead view of the platen 110 in accordance with one embodiment of the present invention. Although an exemplary platen configuration is shown with certain pressure sub-zones, any suitable platen with any suitable number and configuration of fluid pressure zones may be utilized within the system 100 described above in reference to FIG. 2A. For example, fluid pressure zones as those describe in U.S. patent application Ser. No. 09/823,722 entitled "APPARATUS FOR CONTROLLING LEADING EDGE AND TRAILING EDGE POLISHING", and U.S. patent application Ser. No. 10/029,958 entitled "APPARATUS FOR EDGE POLISHING UNIFORMITY CONTROL" may be utilized. These patent applications are hereby incorporated by reference.

In one embodiment, a peripheral fluid output zone 204*a* includes different annular sub-zones that include varying sizes of concentric air pressure zones. It should be appreciated that the peripheral zone 204*a*, as well as a central zone 204*b*, may have any number of sub-zones such as, for example, 2, 3, 4, 5, 6, 7, 8, 9, 10, etc. It should also be understood that the peripheral zone 204*a* and the central zone 204*b* may have any type of sub-zones such as, for example, circular sub-zones, semicircular sub-zones, etc. In one embodiment, the peripheral zone 204*a* has 5 sub-zones including annular sub-zones 204*a*-1, 204*a*-2, 204*a*-3, 204*a*-4, and 204*a*-5, and the central zone 204*b* has one zone with no sub-zones. Each of the sub-zones may be separately controlled so that the air flow rate through the separate sub-zones may be varied to optimize the CMP operation. By individually controlling the air flow rates through the separate sub-zones, variations in pressure can be generated at different diameters on the wafer including areas inside and outside of the wafer circumference. Thus, the plurality of sub-zones within the peripheral zone 204*a* and the central zone 204*b* therefore allow management of temperature and fine tuning of the pressure applied on different areas of the polishing pad 102. This pressure and temperature variation may be used to vary the polishing rates of different parts of a wafer because, as is well known in those skilled in the art, the amount of polishing that occurs on a portion of a wafer is a function of the pressure being applied on the corresponding portion of the polishing pad and a function of the temperature of the polishing pad 102 during polishing. Therefore, more or less sub-zones may be utilized depending the polishing profile requirements. It should also be appreciated that none, one, or more air pressure sub-zones may have a larger circumference than a wafer being polished.

The platen 110 also includes a pre-wet output 232 and a post-wet output 230. The pre-wet output 232 is a line of output holes disposed in an area which encounters the polishing pad 120 before the platen plate 202 when the polishing pad is moving in the direction 106. The post-wet output 230 is a line of output holes disposed in an area which encounters the polishing pad 102 after the platen plate 202 when the polishing pad is moving in the direction 106. The pre-wet output 232 and the post-wet output 230 delivers fluid to an area above the platen 230 so a back surface of the polishing pad 102 may, be cleaned and lubricated during the CMP process.

Figure 4B:
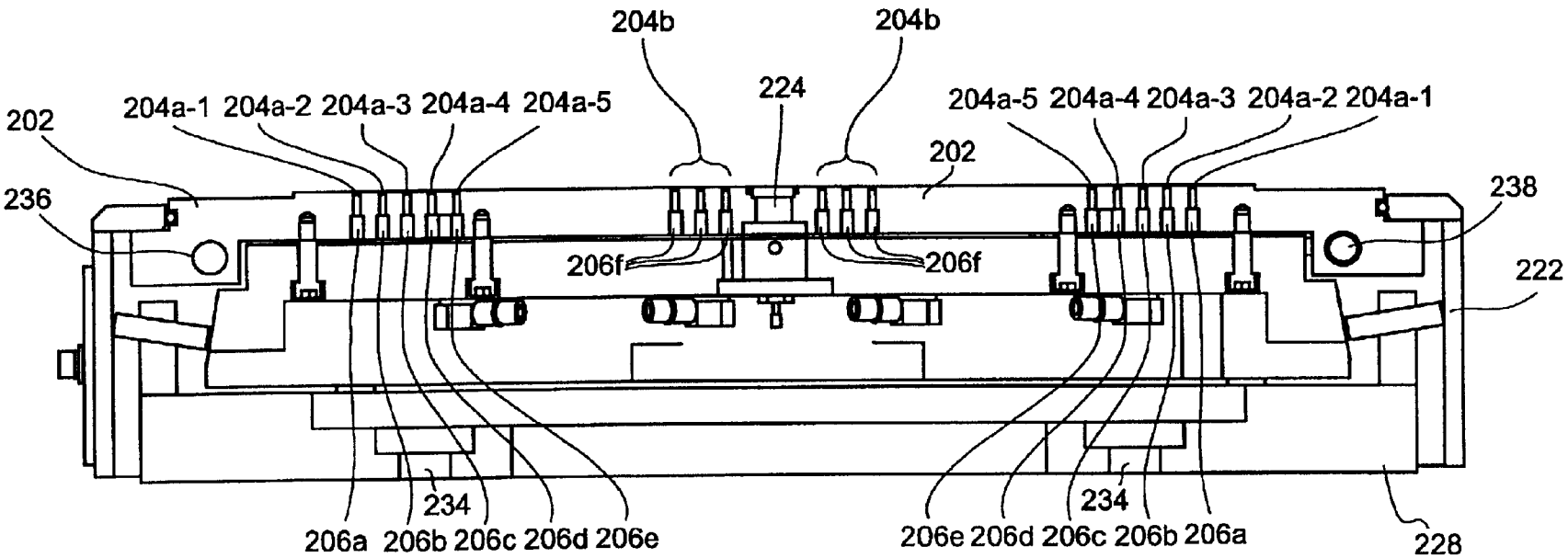
FIG. 4B shows a side view of a diametric slice of the platen as shown in FIG. 4A in accordance with one embodiment of the present invention.

FIG. 4B shows a side view of a diametric slice of the platen 110 as shown in FIG. 4A in accordance with one embodiment of the present invention. The platen includes a platen plate 202, mounting plate 228, and a platen cover 222. In this embodiment, annular recesses 206*a*, 206*b*, 206*c*, 206*d*, 206*e*, and 206*f* that are capable of outputting air are defined within the platen plate 202. It should be understood that any number or configuration of recesses that may output fluid can be utilized depending on the configuration and number of fluid pressure zones desired. For example, in another embodiment the recesses may be semicircular instead of annular, or in yet another embodiment, both annular and semicircular shaped recesses may be used. The annular recesses 206*a*, 206*b*, 206*c*, 206*d*, and 206*e* are configured to receive fluid from at least one fluid input port formed therein and to supply the annular sub-zones 204*a*-1, 204*a*-2, 204*a*-3, 204*a*-4, and 204*a*-5 respectively with fluid so 5 distinct zones of fluid pressure may be created over the peripheral zone 204*a*. The annular recess 206*f* is configured to supply fluid to a central portion of the platen so fluid pressure may be created over the central zone 204*b*. The platen plate 202 may optionally include an end point detection hole 224 which may be utilized for CMP end point detection operations. In addition, an air/water pre-wet line 236 and an air/water post-wet line 238 are defined to form circle through the inside of the platen plate. The air/water pre-wet line 236 may have the pre-wet output 232 to a surface of the platen plate 202. The air/water pre-wet line 238 may have the post-wet output 230 to the surface of the platen plate 202. By injecting water through the line 236 and/or the line 238, the surface of the platen plate 202 may be wetted before commencing CMP operations.

The platen plate 202 is configured to be attached onto the mounting plate 228. The mounting plate 228 is configured to receive fluid from the internal manifold 114 (as shown in FIG. 2A) through mounting plate fluid inputs 234 and to provide the fluid to the annular recesses 206*a*, 206*b*, 206*c*, 206*d*, 206*e*, 206*f*, and 206*g* within the platen plate 202. The platen cover 222 may couple the outside edges of the platen plate 202 and the mounting plate 228 together to keep the platen plate 202 and the mounting plate 228 as a cohesive unit.

Therefore, in operation, air is inputted through inputs 234 and channeled through the mounting plate 228 to fluid input ports feeding the annular recesses 206*a*, 206*b*, 206*c*, 206*d*, 206*e*, 206*f*, and 206*g*. The fluid pressure then forces fluid out to zones 204*a*-1, 204*a*-2, 204*a*-3, 204*a*-4, 204*a*-5, and 204*b*.

Figure 4C:
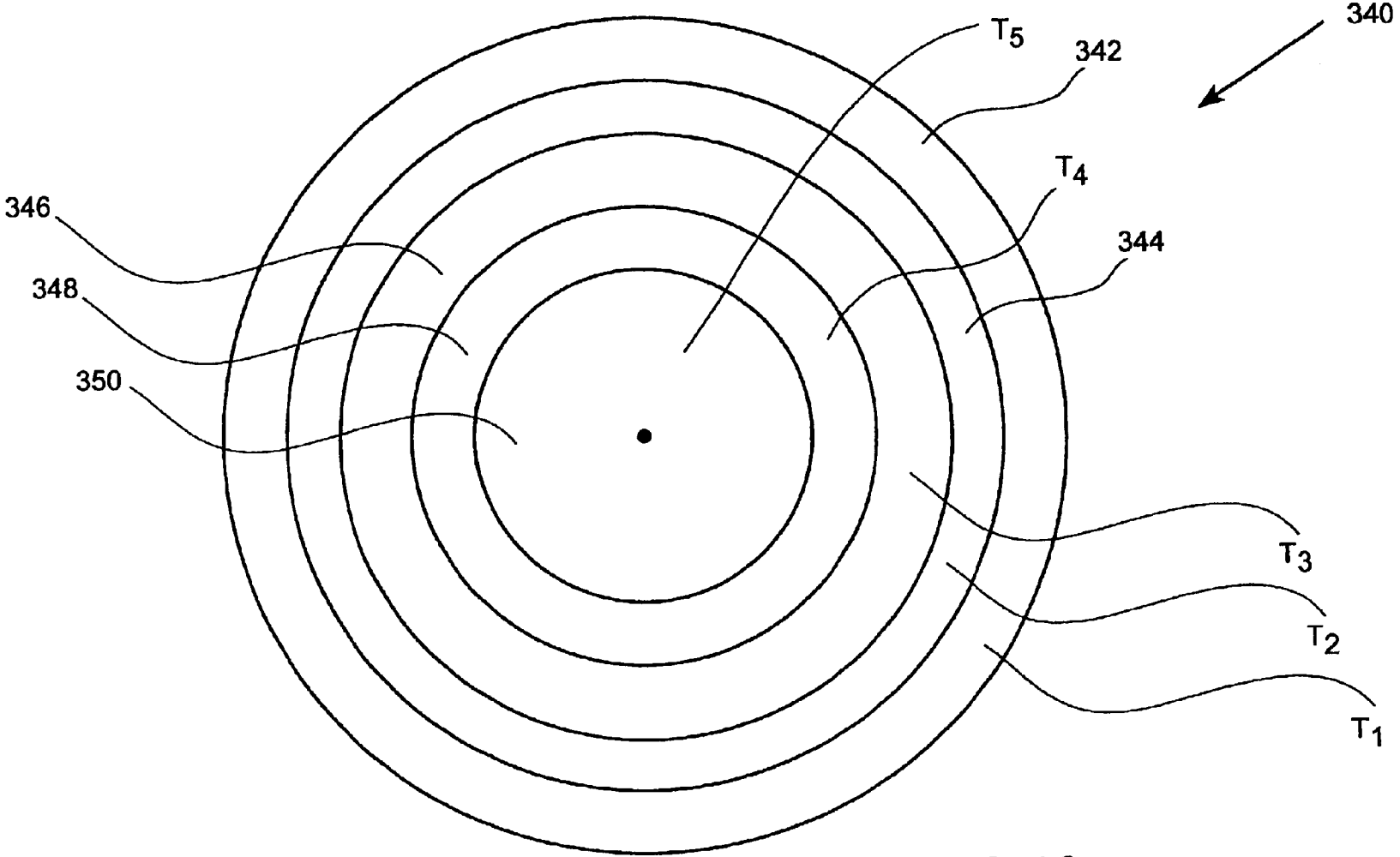
FIG. 4C shows a platen configuration with concentric temperature zones in accordance with one embodiment of the present invention.

FIG. 4C shows a platen configuration 340 with concentric temperature zones in accordance with one embodiment of the present invention. In this embodiment, the platen configuration 340 includes a plurality of concentric pressure zones 342, 344, 346, 348, and a center pressure zone 350. Each of the pressure zones 342, 344, 346, 348, and 350 may output different temperatures of fluid or the same temperature of fluid or any suitable combination of temperature fluids.

Figure 4D:
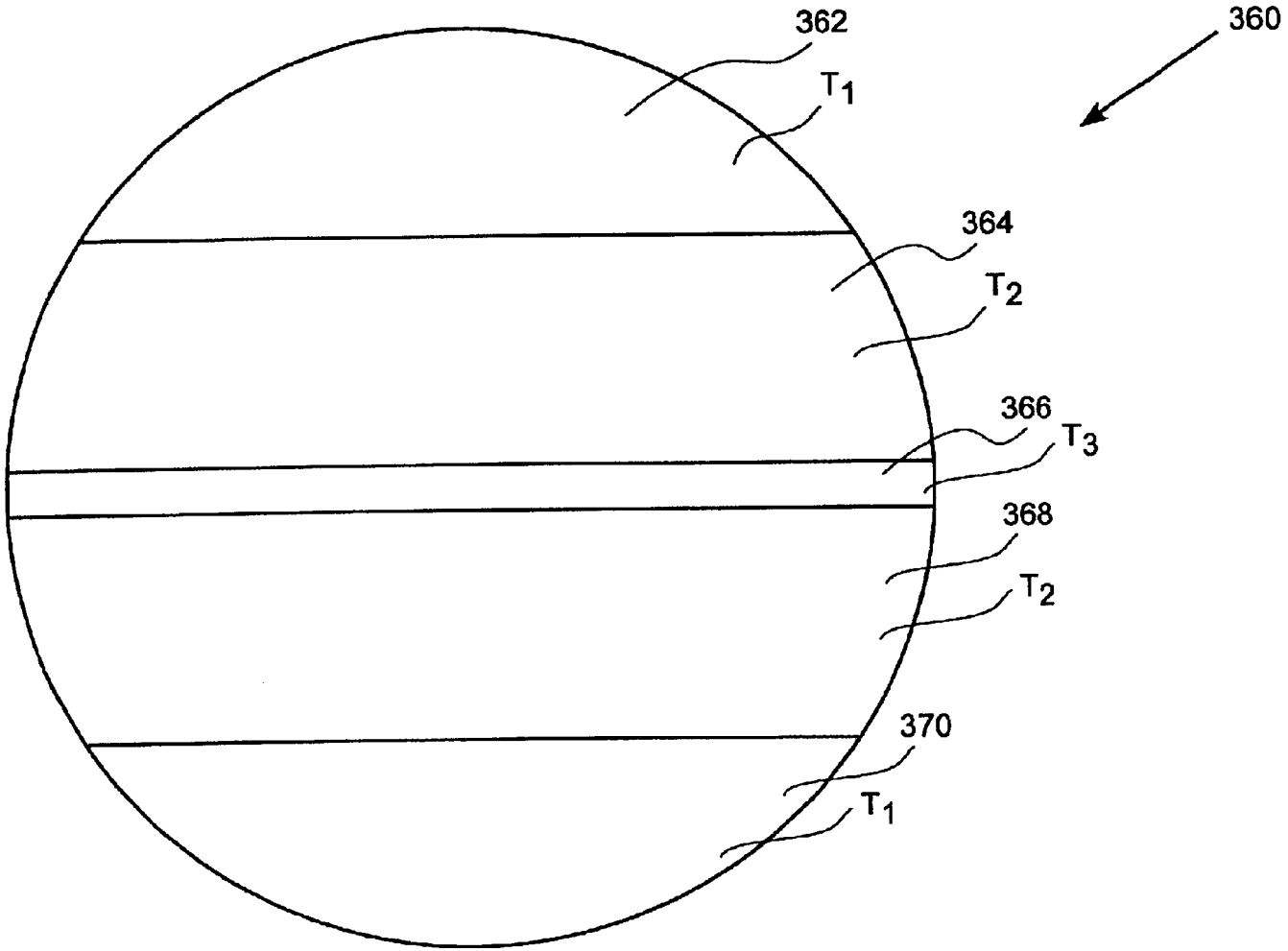
FIG. 4D illustrates a platen configuration with horizontal pressure zones in accordance with one embodiment of the present invention.

FIG. 4D illustrates a platen configuration 360 with horizontal pressure zones in accordance with one embodiment of the present invention. In this embodiment, the platen configuration 360 includes horizontal temperature zones 362, 364, 366, 368, and 370. Each of the horizontal temperature zones may output different temperatures of fluid or the same temperature of fluid or any suitable combination of temperature fluids.

Figure 4E:
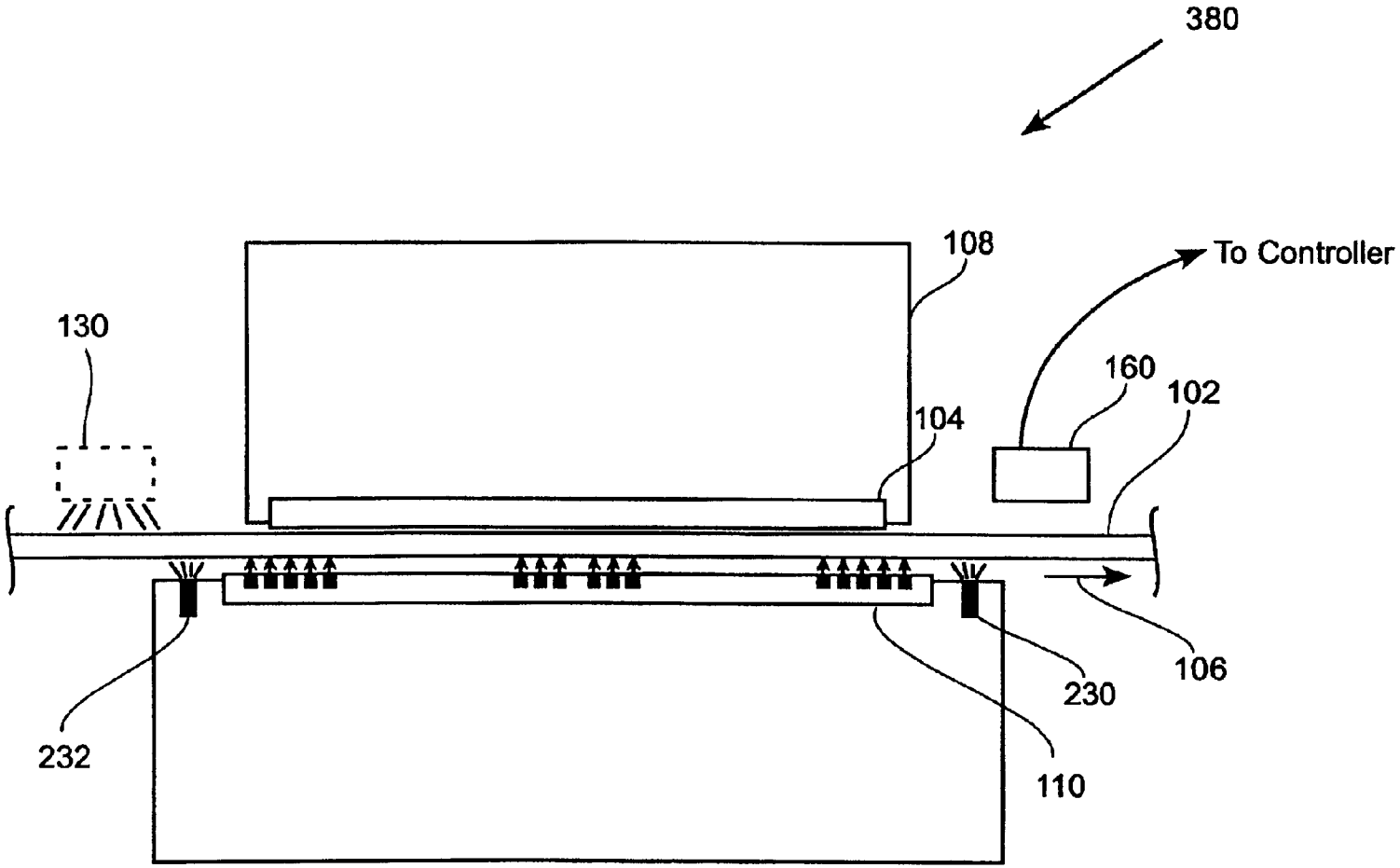
FIG. 4E shows a diagram illustrating a polishing pad heating process in accordance with one embodiment of the present invention.

FIG. 4E shows a diagram 380 illustrating a polishing pad heating process in accordance with one embodiment of the present invention. In this embodiment, the carrier head 108 holding the wafer 104 is pressed down onto the polishing pad 102 moving in the direction 106. In this embodiment, the platen 110 is shown applying heated air to an underside of the polishing pad 102 from a variety of pressure zones. Also, the pre-wet output 232 and the post-wet output 230 are shown to be applying heated water to the underside of the polishing pad 102. At this time, the heat temperature sensor 160 is detecting the temperature of the polishing pad 102 and through a feedback loop, the controller 150 (as shown in FIG. 2A) is monitoring and adjusting the heated fluid applied by the platen 110 and also adjusting the heated water delivered from pre-wet 232 and the post-wet output 230. In addition, the heater 130 may be disposed above the polishing pad 102 and heat the polishing pad to a set temperature. The heater 130 may be optionally used as shown in FIG. 2B or in addition to using heated air through the platen to heat the polishing pad 102.

Figure 5:
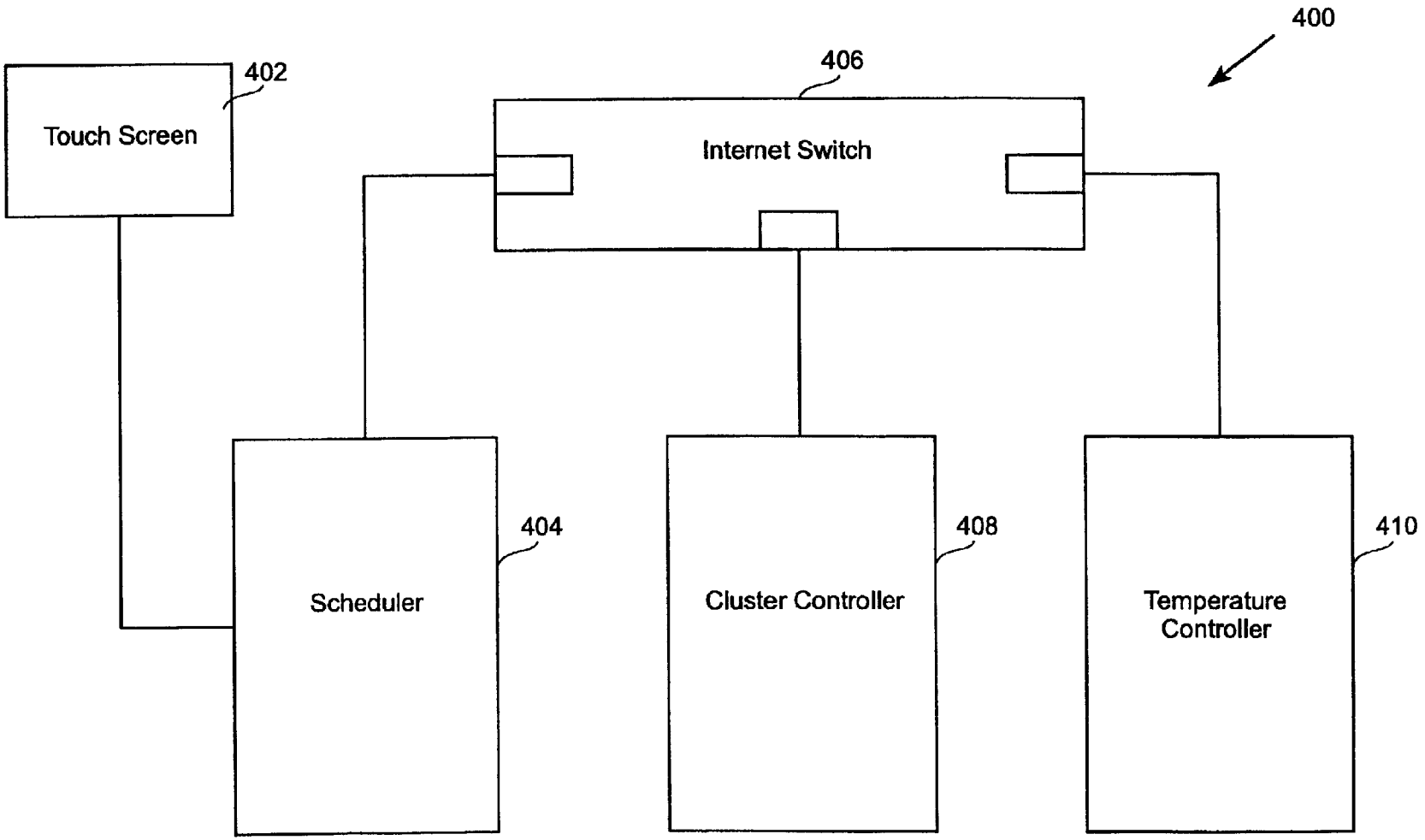
FIG. 5 shows a network diagram illustrating how temperature may be managed through network connections of different components in accordance with one embodiment of the present invention.

FIG. 5 shows a network diagram 400 illustrating how temperature may be managed through network connections of different components in accordance with one embodiment of the present invention. The control diagram shows a touch screen 402 connected to a scheduler 404 which is then connected to an Internet switch 406. The Internet switch 406 is connected to a cluster controller 408 and a temperature controller 410. In one embodiment, the touch screen 402 enables a user to set fluid zones pressure, fluid zones temperature, hot water output and also monitor current fluid zones as well as hot water temperature. The scheduler 404 manages the sending and receiving of data between the touch screen 402 and the internet switch 406. The internet switch 406 directs data sent on the network to the intended locations. The cluster controller 408 manages nodes within the network and assists in the process of resource allocation within the network. The temperature controller 150 can receive a request to set air zones temperature and hot water set point. The temperature controller 150 also may perform proportional, integral, derivative (PID) control (PID control is described in further detail in reference to FIGS. 6A and 6B) for all air zones and hot water temperature. The temperature controller 410 may also transmit current zone temperature and hot water per request synchronously. The temperature controller 410 is any suitable type of controller that is configurable to receive the inputs described above, execute proportional, integral, derivative (PID) control signals (as described in further detail in reference to FIG. 6A), and produce the outputs to control the various controllable devices (e.g., internal manifold). In one embodiment, the temperature controller 410 can be a programmable logic controller (PLC) such as is available from Siemens or any other supplier of suitable PLCs. Alternatively, the controller 410 can be any type of generic computing system such as a personal computer.

Figure 6A:
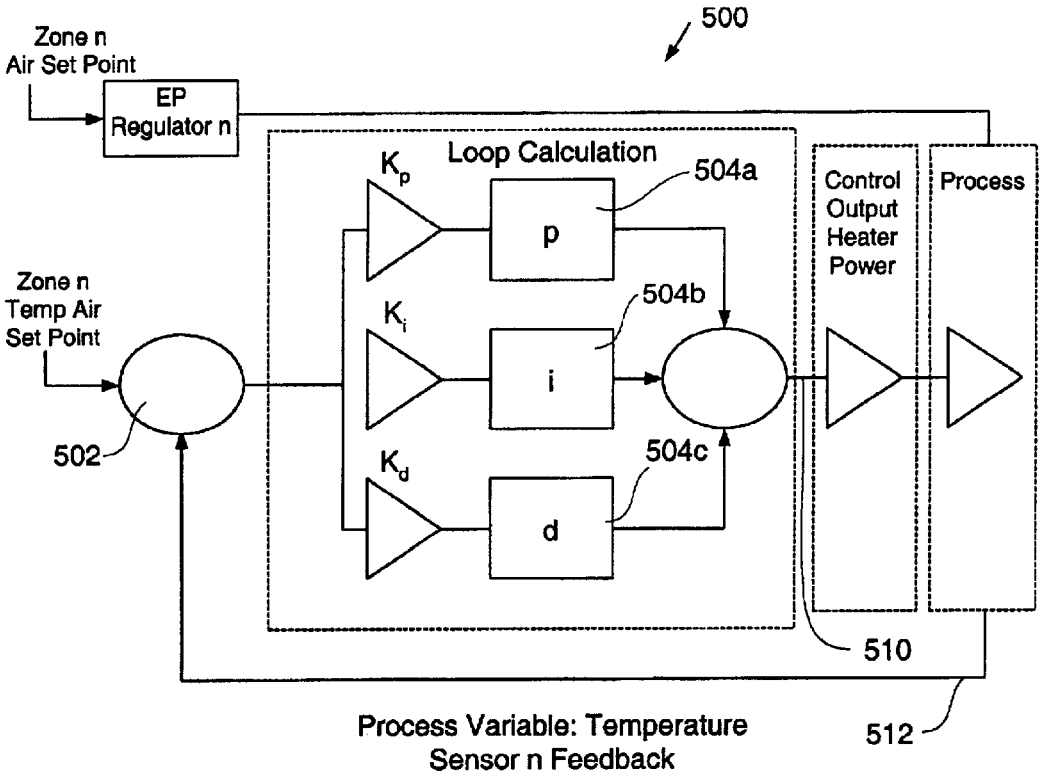
FIG. 6A is a block diagram of proportional, integral, derivative (PID) controls in controlling a temperature of a zone n (where n is the number of the pressure zone(s) being managed) of the platen in accordance with one embodiment of the present invention.

FIG. 6A is a block diagram 500 of proportional, integral, derivative (PID) controls in controlling a temperature of a zone n (where n is the number of the pressure zone(s) being managed) of the platen 110 in accordance with one embodiment of the present invention. It should be appreciated that the PID control described herein may be used to control and manage temperature of any of the pressure zones on the platen 110. In one embodiment, zones 1, 2, 3, 4, 5, and 6 may correspond to the annular sub-zones 204*a*-1, 204*a*-2, 204*a*-3, 204*a*-4, 204*a*-5, and the central zone 204*b* respectively.

Although the PID controls are described in relation to controlling the temperature of zone n of the platen 110, the same principles are applicable to controlling any other control variable such as controlling the flow of the fluid with a particular temperature. A desired set point, such as a desired temperature of the n pressure zone may be set. The n air zone may be any one of the fluid zones located within the platen 110 where the fluid output may be independently controlled. Therefore, the block diagram 500 may be utilized to control the temperature of the fluid output in any fluid output zone. A desired set point, such as a desired temperature of a particular air zone is applied to an input 502. The proportional, integral, derivative variables $K_p$, $K_i$, $K_d$ are extracted from the signal to the input 502. Each of the PID variables are applied to corresponding PID calculations 504*a*, 504*b*, 504*c* to produce a control signal 510. For example, the control signal output may be a zone 1 air temperature control signal. The control signal 510 is then applied to a control output heater power and the process (e.g., zone 1 temperature control signal applied to the control input of the first zone temperature). The process also receives and utilizes a signal for the particular zone being managed from the electronic pressure (EP) regulator. A feedback signal 512 is fed back to the input 502 to provide an error control/feedback. If the set point applied to the input 502 is the desired air temperature is the desired air temperature of air zone 1, then the feedback signal 512 may be a detected air temperature from the air zone 1 such as from a temperature sensor. In such a fashion, all zones of the platen 110 may be controlled and managed in an intelligent manner so the temperature of the polishing pad may be substantially equalized to the set point temperature.

Figure 6B:
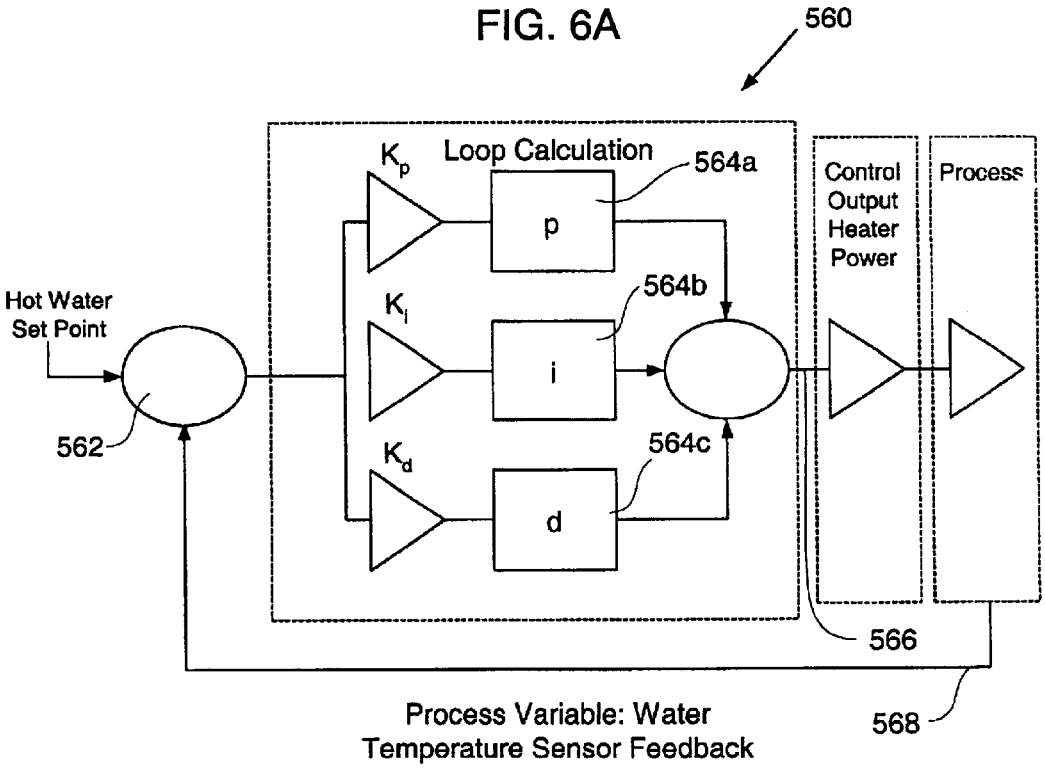
FIG. 6B is a block diagram of proportional, integral, derivative (PID) controls in controlling water temperature delivery by the pre-wet ouput and the post-wet output in accordance with one embodiment of the present invention.

FIG. 6B is a block diagram 560 of proportional, integral, derivative (PID) controls in controlling water temperature delivery by the pre-wet ouput and the post-wet output in accordance with one embodiment of the present invention. The PID controls described in the block diagram 560 are in relation to controlling the temperature and output of heated water through the pre-wet output and the post-wet output. A desired set point, such as a desired temperature of the heated water may be set. The heated water may be transported to the platen 110 and delivered to a top surface of the platen from the pre-wet output and/or the post-wet output. A desired set point, such as a desired temperature of water is applied to an input 562. The proportional, integral, derivative variables $K_p$, $K_i$, $K_d$ are extracted from the signal to the input 562. Each of the PID variables are applied to corresponding PID calculations 564*a*, 564*b*, 564*c* to produce a control signal 566. For example, the control signal output may be a pre-wet heated water control signal. The control signal 566 is then applied to a control ouput heater power and the process (e.g., pre-wet heated water control signal applied to the control input of the polishing pad temperature). A feedback signal 568 is fed back to the input 562 to provide an error control/feedback. In one embodiment, if the set point applied to the input 562 is the desired water temperature is the desired water temperature from the pre-wet output, then the feedback signal 568 may be a detected water temperature from the pre-wet output such as from the temperature sensor.

Figure 7:
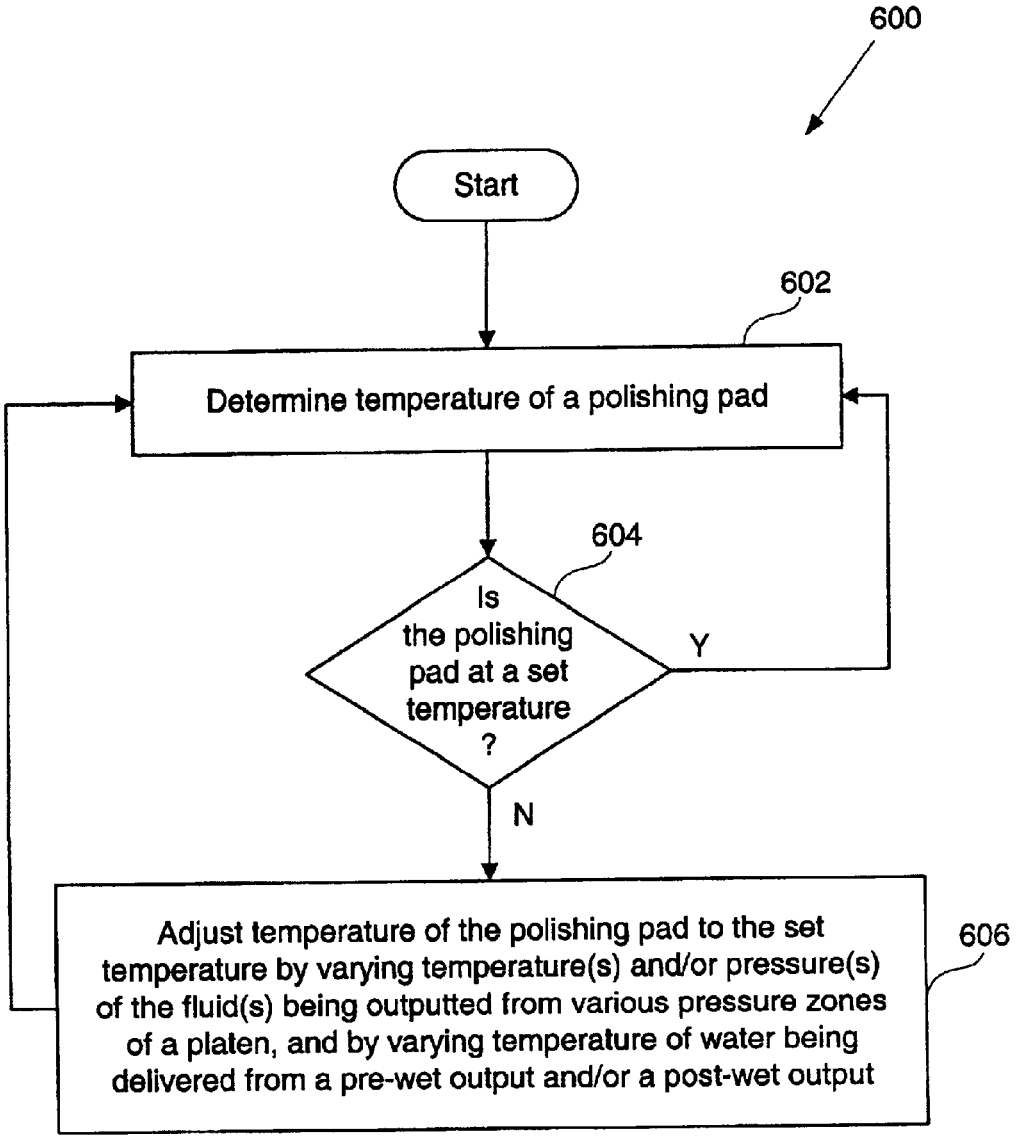
FIG. 7 shows a flowchart illustrating a method of heating the polishing pad in accordance with one embodiment of the present invention.

FIG. 7 shows a flowchart 600 illustrating a method of heating the polishing pad 102 in accordance with one embodiment of the present invention. The method begins with operation 602 which determines a temperature of a polishing pad. In this operation, the controller may receive a signal from a heat sensor indicating the temperature of the polishing pad. After operation 602, the method moves to operation 604 which establishes whether the polishing pad is at a set temperature (also known as set point temperature). In operation 604, the controller compares the polishing pad temperature with the set point temperature. If the polishing pad is not at the set temperature, the method moves to operation 606 which adjusts temperature of the polishing pad to the set temperature by varying temperature(s) and/or pressure(s) of the fluid(s) being outputted from various pressure zones of a platen, and by varying temperature of water being delivered from a pre-wet output and/or a post-wet output.

Therefore, through intelligent management and control of the temperature(s) of fluids being outputted from the platen, the polishing pad temperature may in turn be managed to provide optimal wafer polishing rates. In addition, through the control of the polishing pad temperatures, polishing rates may be customized depending on the polishing rates desired. Therefore, the CMP system described herein enables optimized wafer polishing operations.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A temperature controlling system for use in a chemical mechanical planarization (CMP) system having a linear polishing belt, a carrier capable of applying a substrate over a preparation location over the linear polishing belt, the temperature controlling system comprising:

a platen having a plurality of zones, a temperature sensor configured determine a temperature of the linear polishing belt at a location that is after the preparation location; and a heating device being positioned before the preparation location and directed toward a surface of the linear polishing belt; and a controller for adjusting an output from the heating device in response to output received from the temperature sensor.

2. The temperature controlling system as recited in claim 1, wherein the plurality of zones includes six pressure zones.

3. The temperature controlling system as recited in claim 1, wherein the plurality of zones includes one center zone and one peripheral zone.

4. The temperature controlling system as recited in claim 3, wherein the peripheral zone includes at least 5 annular pressure zones.

5. The temperature controlling system as recited in claim 1, wherein the platen includes a pre-wet output and a post-wet output.

6. The temperature controlling system as recited in claim 5, wherein a temperature of a heated fluid from at least one of the pre-wet output and the post-wet output is capable of being varied.

7. The temperature controlling system as recited in claim 1, wherein the plurality of zones outputs heated fluid.

8. The temperature controlling system as recited in claim 1, wherein the heated fluid is clean dry air.

9. An apparatus for heating a polishing pad during chemical mechanical planarization (CMP), comprising:

a platen disposed under the polishing pad, the platen having a platen plate with at least one pressure zone being capable of outputting a heated fluid to an underside portion of the polishing pad;

an internal manifold coupled to the platen by at least one fluid throughput, the internal manifold being capable of delivering the heated fluid to the at least one pressure zone of the platen by way of the at least one fluid throughput;

an external manifold coupled to the internal manifold by at least one manifold throughput, the external manifold being capable of delivering the heated fluid to the internal manifold;

a heater connected to the external manifold by at least one heater throughput, the heater being capable of heating the fluid to one of a plurality of set temperatures and being capable of delivering the heated fluid to the external manifold; and a controller connected to the internal manifold and a polishing pad temperature sensor, the controller being capable of monitoring a polishing pad temperature and adjusting a delivery of the heated fluid from the internal manifold to the at least one pressure zone to equalize the polishing pad temperature to the set point temperature.

10. An apparatus for heating a polishing pad as recited in claim 9, wherein the at least one pressure zone includes six pressure zones.

11. An apparatus for heating a polishing pad as recited in claim 10, wherein the at least one pressure zone includes one center zone and one peripheral zone.

12. An apparatus for heating a polishing pad as recited in claim 11, wherein the peripheral zone includes at least 5 annular pressure zones.

13. An apparatus for heating a polishing pad as recited in claim 9, wherein the platen includes a pre-wet output and a post-wet output.

14. An apparatus for heating a polishing pad as recited in claim 13, wherein a temperature of a heated fluid from at least one of the pre-wet output and the post-wet output is capable of being varied.

15. An apparatus for heating a polishing pad as recited in claim 9, wherein the polishing pad is defined by one of a linear polishing pad and an orbital polishing pad.

16. An apparatus for heating a polishing pad as recited in claim 9, wherein the heater is capable of heating air up to about 125 degrees F.

* * * * *